US010270148B2

(12) United States Patent
Cai

(10) Patent No.: US 10,270,148 B2
(45) Date of Patent: Apr. 23, 2019

(54) MICROSTRIP MULTIPLEXER

(71) Applicant: HUAWEI TECHNOLOGIES CO., LTD., Shenzhen, Guangdong (CN)

(72) Inventor: Yu Cai, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/493,241

(22) Filed: Apr. 21, 2017

(65) Prior Publication Data

US 2017/0222293 A1 Aug. 3, 2017

Related U.S. Application Data

(63) Continuation of application No. PCT/CN2014/089245, filed on Oct. 23, 2014.

(51) Int. Cl.

| | |
|---|---|
| ***H01P 3/08*** | (2006.01) |
| ***H01P 5/16*** | (2006.01) |
| ***H01P 1/203*** | (2006.01) |
| ***H01P 1/213*** | (2006.01) |

(52) U.S. Cl.

CPC ..... *H01P 1/2135* (2013.01); *H01P 1/20336* (2013.01); *H01P 3/081* (2013.01); *H01P 5/16* (2013.01)

(58) Field of Classification Search

CPC .. H01P 3/08; H01P 3/081; H01P 7/082; H01P 1/2135; H01P 1/20381

USPC ..... 333/134

See application file for complete search history.

(56) References Cited

U.S. PATENT DOCUMENTS 6,108,569 A * 8/2000 Shen ..... H01P 1/20381 333/134
2008/0258964 A1 10/2008 Schoeberl et al.
2012/0063471 A1 3/2012 Yin et al.

FOREIGN PATENT DOCUMENTS

| | | | |
|---|---|---|---|
| CN | 1669177 | A | 9/2005 |
| CN | 1901437 | A | 1/2007 |
| CN | 101076741 | A | 11/2007 |
| CN | 201243077 | Y | 5/2009 |
| CN | 101533940 | A | 9/2009 |

(Continued)

OTHER PUBLICATIONS

International Search Report dated Jul. 22, 2015 in corresponding International Patent Application No. PCT/CN2014/089245.

(Continued)

*Primary Examiner* — Robert J Pascal
*Assistant Examiner* — Kimberly E Glenn
(74) *Attorney, Agent, or Firm* — Staas & Halsey LLP

(57) ABSTRACT

Embodiments of the present invention disclose a microstrip multiplexer, including a feeder, multiple microstrip filters, and a signal processing network. The multiple microstrip filters are separately connected to the signal processing network, and the signal processing network is connected to the feeder. Output signals of the microstrip filters of the multiple microstrip filters are combined by using the signal processing network and then output by using the feeder and/or a signal input from the feeder is split by using the signal processing network and then output to the microstrip filters. In the embodiments of the present invention, a wideband multiplexer that combines multiple wide subband signals for using can be implemented, and each subband has good frequency band response.

12 Claims, 6 Drawing Sheets

(56) References Cited

FOREIGN PATENT DOCUMENTS

| | | | |
|---|---|---|---|
| CN | 202454694 | U | 9/2012 |
| CN | 203166051 | U | 8/2013 |
| CN | 103280613 | A | 9/2013 |
| KR | 100691134 | B1 | 2/2007 |
| KR | 20080068359 | | 7/2008 |
| KR | 20080068359 | A | 7/2008 |
| WO | 97/15091 | | 4/1997 |

OTHER PUBLICATIONS

Cao Hai-Lin et al. "Design of micro-strip open loop diplexers" Journal of Chongqing University of Posts and Telecommunications (Natural Science), vol. 18, No. 1, Feb. 2006.
International Search Report dated Jul. 22, 2015 in corresponding International Application No. PCT/CN2014/089245.
Chinese Office Action dated Sep. 4, 2018 in corresponding Chinese Patent Application No. 201480082663.0, 8 pgs.

* cited by examiner

MICROSTRIP MULTIPLEXER

CROSS-REFERENCE TO RELATED APPLICATIONS

This Application is a continuation of International Application No. PCT/CN2014/089245, filed on Oct. 23, 2014, the disclosure of which is hereby incorporated by reference in its entirety.

TECHNICAL FIELD

The present invention relates to the field of communications technologies, and in particular, to a microstrip multiplexer.

BACKGROUND

As communications technologies develop, a communications system becomes increasingly complex, and it is increasingly common that multiple receivers and transmitters in the communications system work simultaneously. A multiplexer is an important apparatus that enables multiple receivers and transmitters to work simultaneously by using a same antenna and is currently widely applied to many communications systems. For example, a duplexer is a three-port device, which is widely applied to an FDD (Frequency Division Duplexing) system.

Conventional multiplexers are all of a narrowband structure. A multiplexer designed based on a conventional structure is applicable only to a scenario with a relatively narrow bandwidth. Therefore, common multiplexers are mainly duplexers. Constrained by the structure itself, a higher-level multiplexer such as a triplexer, a quadplexer, or a quintuplexer, or a wideband multiplexer can hardly be designed based on the conventional structure. However, in the communications system, multiple wideband signals are often combined for transmission and/or receiving. Therefore, it is important to design a wideband multiplexer.

SUMMARY

Embodiments of the present invention provide a microstrip multiplexer, so as to implement a wideband multiplexer that combines multiple wide subband signals for using, and each subband has good frequency band response.

According to a first aspect, an embodiment of the present invention provides a microstrip multiplexer, including:

a feeder, multiple microstrip lifters, and a signal processing network, where the multiple microstrip filters are separately connected to the signal processing network, and the signal processing network is connected to the feeder; and output signals of the microstrip filters of the multiple microstrip filters are combined by using the signal processing network and then output by using the feeder, and/or a signal input from the feeder is split by using the signal processing network and then output to the microstrip filters.

By implementing the embodiments of the present invention, multiple microstrip filters are connected to a signal processing network. The signal processing network receives output signals from the multiple microstrip filters, combines the output signals, and then outputs a combined signal by using a feeder, and/or a signal input from the feeder is split by using the signal processing network and then output to the microstrip filters, in the embodiments of the present invention, a wideband multiplexer that combines multiple wide subband signals for using can be implemented, and each subband has good frequency band response.

BRIEF DESCRIPTION OF DRAWINGS

To describe the technical solutions in the embodiments of the present invention more dearly, the following briefly describes the accompanying drawings required for describing the embodiments. Apparently, the accompanying drawings in the following description show merely some embodiments of the present invention, and persons of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely some but not all of the embodiments of the present invention. All other embodiments obtained by persons of ordinary skill in the art based on the embodiments of the present invention without creative efforts shall fall within the protection scope of the present invention.

An embodiment of the present invention provides a microstrip multiplexer. The microstrip multiplexer not only can combine multiple narrow subband signals for using, but also can combine multiple wide subband signals for using. Therefore, the microstrip multiplexer is a wideband multiplexer. Based on the embodiments of the present invention, a multiplexer such a duplexer, a triplexer, a quadplexer, or a quintuplexer, or a wideband multiplexer may be designed. The multiplexer or the wideband multiplexer has a simple structure, and each subband has good frequency band response. Specifically, a designed microstrip multiplexer may be applied to data backhaul in a high-speed railway scenario or may be applied to various devices for receiving or sending data in a television broadcasting system, a communications system, or another system. The following describes in detail the microstrip multiplexer with reference to FIG. 1 to FIG. 6.

Figure 1:
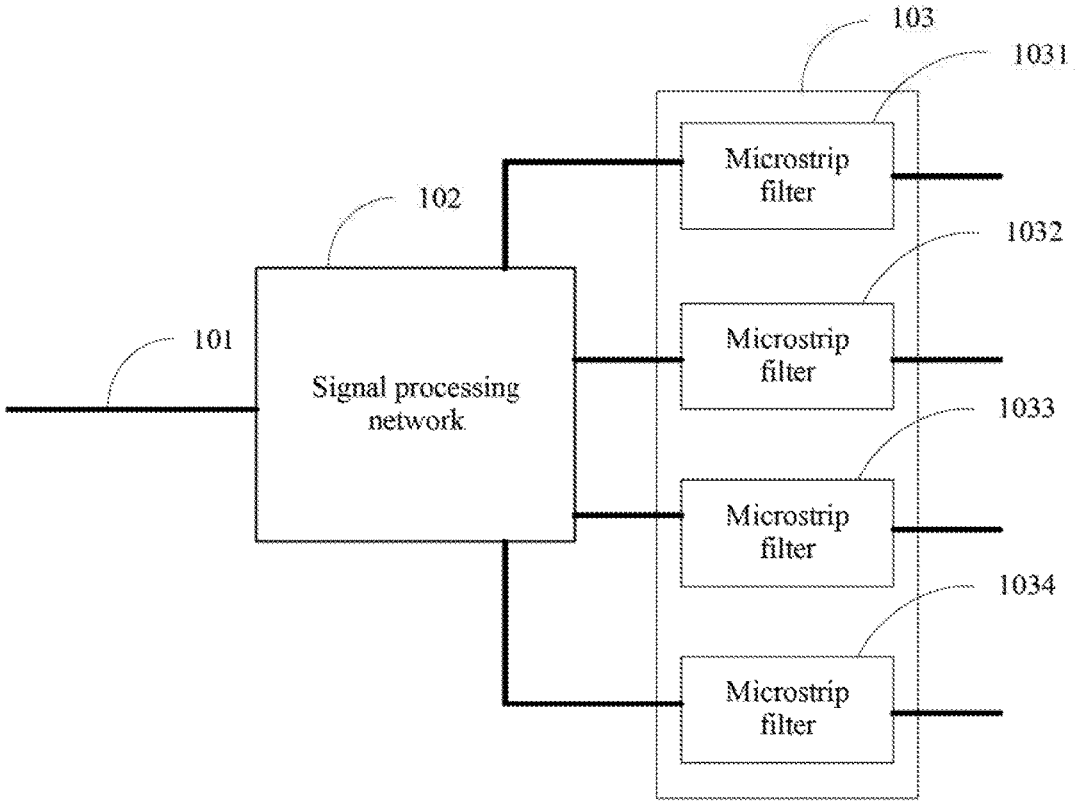
FIG. 1 is a schematic structural diagram of a microstrip multiplexer according to an embodiment of the present invention.

Referring to FIG. 1, FIG. 1 is a schematic structural diagram of a microstrip multiplexer according to an embodiment of the present invention. In this embodiment of the present invention, the microstrip multiplexer includes a feeder 101, a signal processing network 102, and multiple microstrip filters 103. In this embodiment of the present invention, a quantity of the microstrip filters 103 is N, and $N \geq 2$. Specifically, the quantity N may be set according to an actual requirement. For example, when a triplexer is designed, N=3; or when a quintuplexer is designed, N=5. It should be noted that, in this embodiment of the present invention, a designed microstrip multiplexer is not limited to a duplexer or a triplexer. Theoretically, when there is no parasitic frequency band in the microstrip filters, a multiplexer of any level or a wideband multiplexer may be designed. For ease of description, in this embodiment of the present invention, N=4 is used as an example for description. Therefore, the multiplexer in this embodiment of the present invention is presented as quadplexer. However, in this embodiment of the present invention, the multiplexer is not limited to a quadplexer.

The signal processing network 102 is a multi-port device, including combining port and multiple splitting ports. The microstrip filters (1031-1034) are respectively connected to different splitting ports of the signal processing network 102. The signal processing network 102 is connected to the feeder 101 by using the combining port. Multiple subband signals transmitted from the microstrip filters are transmitted on the feeder 101. The subband signals may be narrowband signals or wideband signals. The feeder 101 is connected to an antenna, another processing device (such as a base station), or the like. The subband signals are passband signals of the microstrip filters. The microstrip filters (1031-1034) of the multiple microstrip filters 103 output signals to the signal processing network 102. The signal processing network 102 combines the output signals of the microstrip filters, and outputs a combined signal by using the feeder 101; and/or the signal processing network 102 splits an input signal transferred from the feeder 101, and outputs multiple signals obtained through splitting to the microstrip filters (1031-1034), so that each microstrip filter outputs a narrowband signal or a wideband signal in a passband of the microstrip filter.

In a feasible implementation manner of this embodiment of the present invention, a Wilkinson power divider is disposed in the signal processing network 102. The Wilkinson power divider is a power splitter, and is configured to divide energy of an input signal into two or more, to output equal or unequal energy. Because of a structure feature of the Wilkinson power divider, the Wilkinson power divider has advantages such as a high frequency band, high isolation, and a small insertion loss. When the Wilkinson power divider is used as a signal processing network of a microstrip multiplexer, microstrip multiplexers of various levels or a wideband multiplexer may be designed, each subband has good frequency band response, such as high isolation, and a situation in which the passbands of the microstrip filters overlap may even be handled.

In another feasible implementation manner of this embodiment of the present invention, the signal processing network 102 may be a non-standard T-shaped junction in which an impedance transformer is disposed. (For details, refer to the embodiment described in FIG. 3 or FIG. 5). Because the impedance transformer is disposed in the non-standard T-shaped junction, the impedance transformer can implement impedance matching between the microstrip filters and the feeder. When a signal of a subband is reflected back, another subband is not affected. Therefore, the multiplexer is enabled to perform a wideband-related operation. A quantity of sections of the impedance transformer may be set and optimized according to an impedance of each microstrip filter and a characteristic impedance of a parallel branch line of the T-shaped junction, thereby implementing a wide bandwidth and high isolation of the microstrip multiplexer by using the multi-section impedance transformer. This ensures good frequency band response of each subband.

In this embodiment of the present invention, the microstrip filters may be parallel-coupled microstrip filters, hairpin filters, quarter-wave short-circuited stub filters, interdigital microstrip filters, or the like. However, in a implementation manner, the microstrip filters are interdigital microstrip filters. The interdigital microstrip filters not only can be designed to be compact in structure and small in size, but also have no spurious second harmonic or even-order harmonic, so as to effectively suppress spurious response. In this way, a microstrip multiplexer of a higher level can be designed.

In the microstrip multiplexer described in this embodiment of the present invention, multiple microstrip filters are connected to a signal processing network. The signal processing network receives output signals from the multiple microstrip filters, combines the output signals, and then outputs a combined signal by using a feeder, and/or a signal input from the feeder is split by using the signal processing network and then output to the microstrip filters. In this embodiment of the present invention, a wideband multiplexer that combines multiple wide subband signals for using can be implemented, and each subband has good frequency band response.

Figure 2:
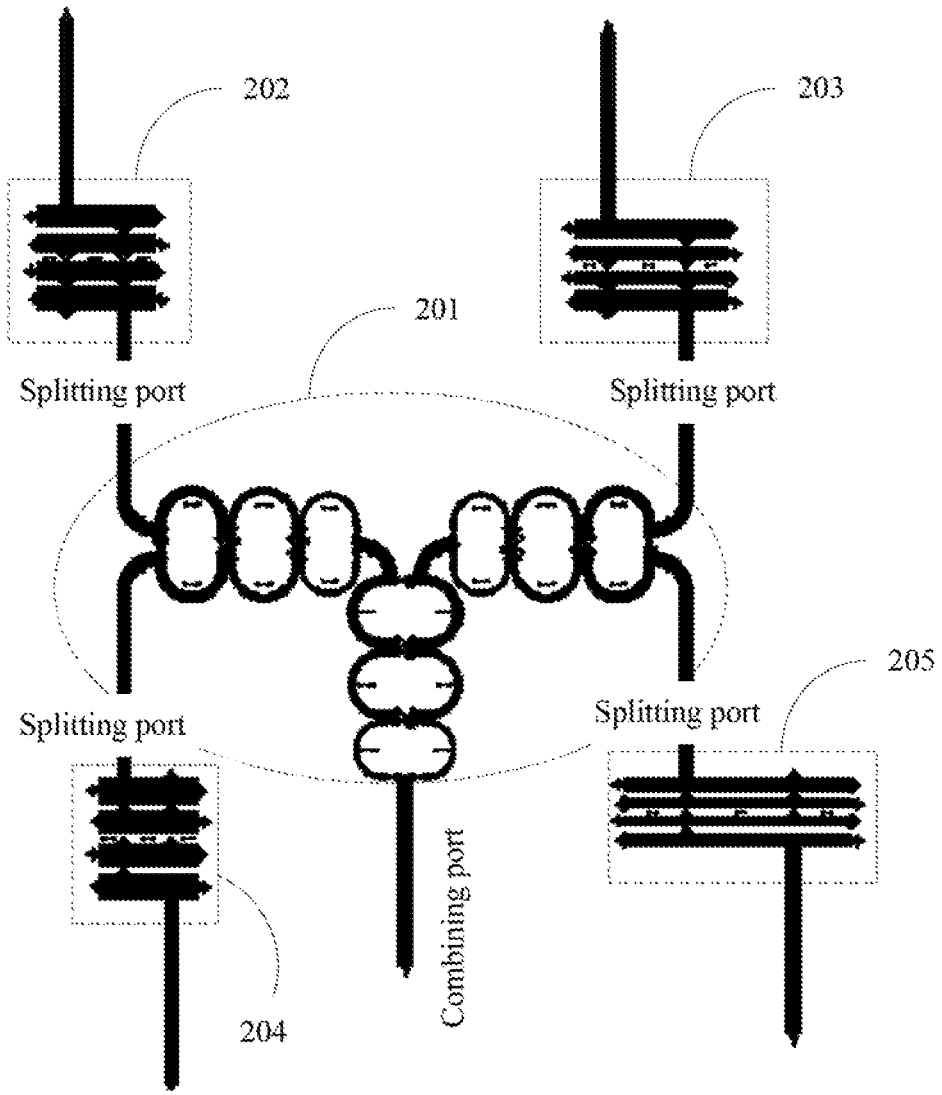
FIG. 2 is another schematic structural diagram of a microstrip multiplexer according to an embodiment of the present invention.

Referring to FIG. 2, FIG. 2 is another schematic structural diagram of a microstrip multiplexer according to an embodiment of the present invention. In this embodiment of the present invention, the microstrip multiplexer includes a Wilkinson power divider 201 and interdigital microstrip filters 202-205. In this embodiment of the present invention, a model of the Wilkinson power divider and a quantity N ($N \geq 2$) of the interdigital microstrip filters are selected according to an actual requirement. For example, when an octaplexer is designed, N=8, and an eight-way Wilkinson power divider is selected. For ease of description, in this embodiment of the present invention, N=4 is used as an example for description. Therefore, the multiplexer in this embodiment of the present invention is presented as a quadplexer. However, in this embodiment of the present invention, the multiplexer is not limited to a quadplexer.

In this embodiment of the present invention, the Wilkinson power divider 201 is a four-way Wilkinson power divider and has four splitting ports and one combining port. The interdigital microstrip filters (202-205) are separately connected to the Wilkinson power divider 201 by using different splitting ports. The combining port of the Wilkinson power divider 201 is connected to a feeder. Multiple subband signals transmitted from the microstrip filters are transmitted on the feeder. The feeder is connected to an antenna, another processing device (such as a base station), or the like. The multiple subband signals may be narrowband signals or wideband signals. The Wilkinson power divider has a simple structure and is easy to be designed, and has advantages such as good port matching performance, a low loss, and high isolation. The interdigital microstrip fitters not only can be designed to be compact in structure and small in size, but also have no spurious second harmonic or even-order harmonic, so as to effectively suppress spurious response. Therefore, the interdigital microstrip filters are applicable to design of a multi-subband multiplexer, so that a bandwidth of the designed microstrip multiplexer is maximized.

In the microstrip multiplexer described in this embodiment of the present invention, a Wilkinson power divider may combine or split power of an input signal. Output signals of multiple microstrip filters are combined and then output by using a feeder, and/or the Wilkinson power divider splits an input signal transferred from the feeder into multiple signals and separately outputs the multiple signals to the microstrip filters. In this embodiment of the present invention, a wideband multiplexer that combines multiple wide subband signals for using can be implemented, and each subband has good frequency band response.

Figure 3:
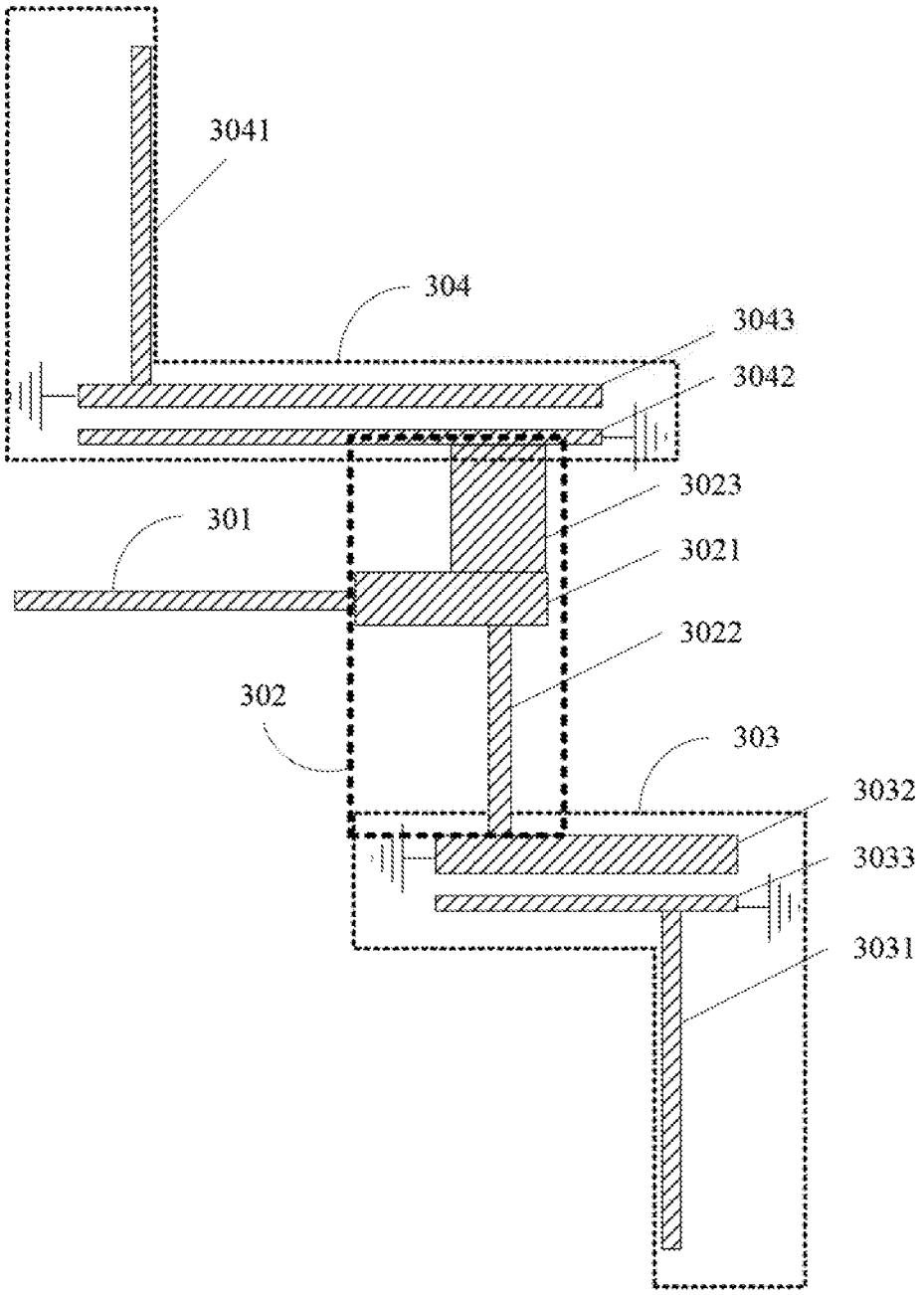
FIG. 3 is still another schematic structural diagram of a microstrip multiplexer according to an embodiment of the present invention.

Referring to FIG. 3, FIG. 3 is still another schematic structural diagram of a microstrip multiplexer according to an embodiment of the present invention. In this embodiment of the present invention, the microstrip multiplexer includes a feeder 301, at least one T-shaped head 302, and multiple microstrip filters (303 and 304). Each T-shaped head includes an impedance transformer, a first parallel branch line, and a second parallel branch line. The first parallel branch line and the second parallel branch line are connected to the impedance transformer in a shape of "T", each microstrip filter is connected to the first parallel branch line or the second parallel branch line, and the impedance transformer in the at least one T-shaped head is connected to the feeder. The T-shaped head is configured to implement impedance matching between the multiple microstrip filters and the feeder.

In this embodiment of the present invention, a quantity of the microstrip filters is N, and N≥2. Specifically, the quantity N needs to be set according to an actual requirement. For example, when a triplexer is designed, N=3; or when a quintuplexer is designed, N=5. A quantity of the T-shaped head is set according to the quantity of the microstrip multiplexers. For ease of description, in this embodiment of the present invention, N=2 is used as an example for description. Therefore, the multiplexer in this embodiment of the present invention is presented as a duplexer, and a quantity of the T-shaped head is one. However, in this embodiment of the present invention, the multiplexer is not limited to a duplexer, and the duplexer is used merely to describe this embodiment of the present invention, and is one form of the present invention.

The T-shaped head 302 includes an impedance transformer 3021, a first parallel branch line 3022, and a second parallel branch line 3023. The first parallel branch line 3022 and the second parallel branch line 3023 are connected to the impedance transformer 3021 in a shape of "T". The T-shaped head 302 is configured to implement impedance matching between the multiple microstrip filters (303 and 304) and the feeder 301. Generally; the feeder 301 includes a microstrip with a characteristic impedance of 50 ohms, and certainly, may include a microstrip with a characteristic impedance of 75 ohms or another value of resistance. Specifically, the feeder 301 may be set according to an actual requirement. For ease of description, in this embodiment of the present invention, a feeder with a characteristic impedance of 50 ohms is used as an example. However, this embodiment of the present: invention sets no limitation thereto.

The microstrip filters (303 and 304) may be parallel-coupled microstrip filters, hairpin filters, quarter-wave short-circuited stub filters, interdigital microstrip filters, or the like. Specifically, a microstrip filter includes multiple resonators and a pigtail. A specific order of the resonators may be determined according to a performance parameter of a microstrip filter that needs to be designed. In this embodiment of the present invention, for ease of description, interdigital microstrip filters are used as an example. Resonators of the interdigital microstrip filters are order-2 resonators. However, this embodiment of the present invention sets no limitation thereto. For ease of description, two microstrip filters are respectively referred to as a first filter 303 and a second filter 304. As shown in FIG. 3, the first filter 303 includes a pigtail 3031, a first-stage resonator 3032, and a second-stage resonator 3033. The first-stage resonator 3032 of the first filter 303 and the second-stage resonator 3033 of the first filter 303 are arranged in parallel. The second filter 304 includes a pigtail 3041, a first-stage resonator 3042, and a second surge resonator 3043. The first-stage resonator 3042 of the second filter 304 and the second-stage resonator 3043 of the second filter 304 are arranged in parallel. Generally, a pigtail includes a microstrip with a characteristic impedance of 50 ohms. A feeding manner of a pigtail of a microstrip filter includes coupled feeding and tapped feeding. For ease of description, in this embodiment of the present invention, the tapped feeding manner is used as an example. The pigtail 3031 of the first filter 303, the pigtail 3041 of the second filter 304, and the feeder 301 have a same characteristic impedance, for example, all have a characteristic impedance of 50 ohms. Therefore, microstrip widths thereof are equal. A length of each resonator is approximate to a quarter-wave length corresponding to a center frequency in a passband of a filter to which the resonator belongs. One end of the resonator is grounded, and another end of the resonator is open-circuited. Open-circuited ends of adjacent resonators are in opposite directions. Each resonator may be a round bar or a rectangular bar. In this embodiment of the present invention, the rectangular bar is used as an example. Specifically, the length and a width of each resonator and a width of a gap between adjacent resonators are set and optimized according to a constraint of a performance parameter such as a passband bandwidth, a center frequency, a Q value, an insertion loss, or a return loss of a target microstrip filter that needs to be designed. In addition, because input and output impedances are affected by tap positions of input and output pigtails, the tap positions of the pigtails also need to be set and optimized according to a known performance parameter. For example, in an interdigital microstrip filter, an order of a resonator is affected by a bandwidth of the microstrip filter, and generally, a higher bandwidth indicates a larger order of the resonator; an insertion loss, a coupling factor, or the like of the microstrip filter determines a width of a gap between resonators; and a microstrip width of the resonator is affected by a Q value.

The T-shaped head 302 is connected to the feeder 301, and the first filter 303 and the second filter 304 are separately connected to the T-shaped head 302. Details may be as follows: The first-stage resonator 3032 of the first filter 303 is perpendicularly connected to the first parallel branch line 3022 of the T-shaped head 302, and the first-stage resonator 3042 of the second filter 304 is perpendicularly connected to the second parallel branch line 3023 of the T-shaped head 302. A feeding manner of the pigtails (3041 and 3031) of the microstrip filters includes coupled feeding and tapped feeding. The first parallel branch line 3022 and the second parallel branch line 3023 are connected to the impedance transformer 3021 in a shape of "T", and the impedance transformer 3021 is connected to the feeder 301. The impedance transformer 3021 is configured to implement impedance matching between the feeder 301 and the first parallel branch line 3022, a first tributary of the first filter 303, the second parallel branch line 3023, and a second tributary of the second filter 304, so that a parallel impedance of the first tributary and the second tributary is equal to the characteristic impedance of the feeder 301, thereby ensuring maximum impedance matching and passband isolation. In this embodiment of the present invention, the T-shaped head is a non-standard T-shaped junction. A microstrip width of the first parallel branch line 3022 and a microstrip width of the second parallel branch line 3023 may be equal or unequal, and may be specifically set and optimized according to an actual situation. The designed multiplexer is of a wideband structure. The multiplexer not only can implement impedance matching between multiple narrow subband filters, but also can implement impedance matching between multiple wide subband filters, and has good frequency band response.

Figure 4:
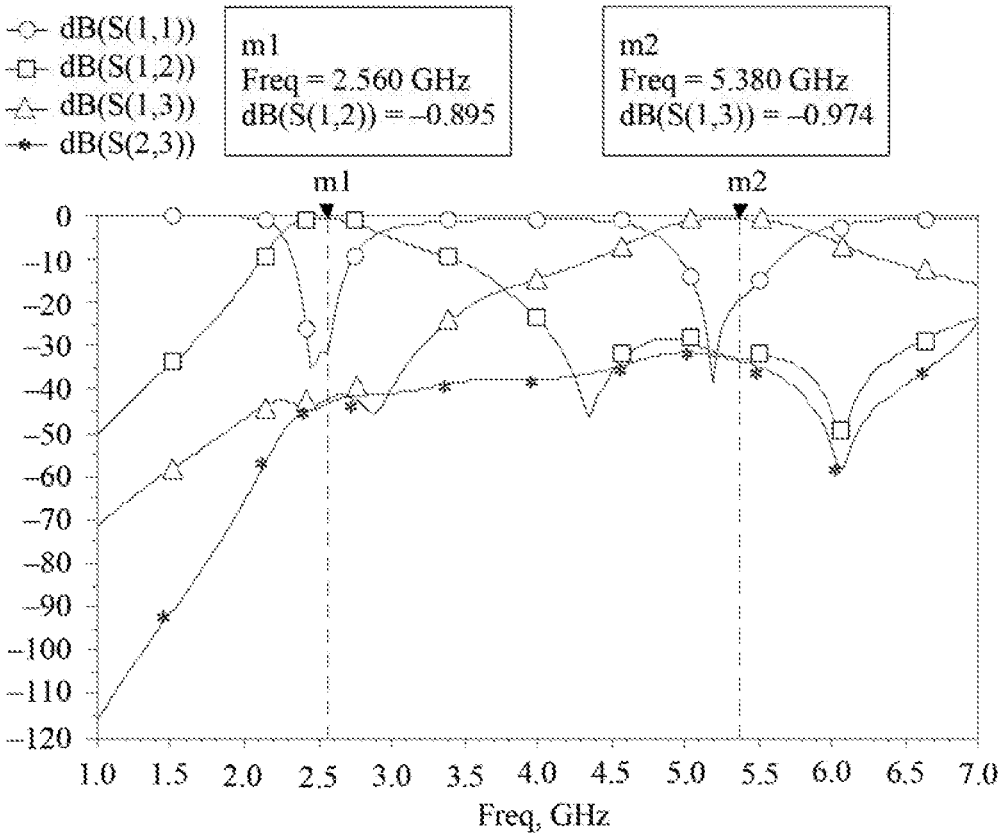
FIG. 4 is a schematic diagram of a frequency response of the microstrip multiplexer provided in FIG. 3.

Referring to FIG. 4, FIG. 4 is a schematic diagram of a frequency response of the microstrip multiplexer provided in FIG. 3. The frequency response includes an insertion loss frequency response {dB(1,2), dB(1,3)}, a return loss frequency response dB(1,1), and isolation dB(2,3). It can be seen from the figure that the designed multiplexer is a wideband multiplexer. A passband bandwidth of each filter is approximately 300 MHz, and the filters have good frequency band response and good isolation. However, a passband bandwidth of each filter in a conventional multiplexer generally is narrow, and ranges from 20 MHz to 80 MHz, and the conventional multiplexer is a narrowband multiplexer.

In the microstrip multiplexer described in this embodiment of the present invention, an impedance transformer in a T-shaped head can implement impedance matching between tributaries on two arms of the T-shaped head and a transmission line connected to the impedance transformer, thereby ensuring maximum impedance matching and passband isolation. In this embodiment of the present invention, a multiplexer or a wideband multiplexer that combines multiple wide subband signals for using can be implemented, and each subband has good frequency band response.

Figure 5:
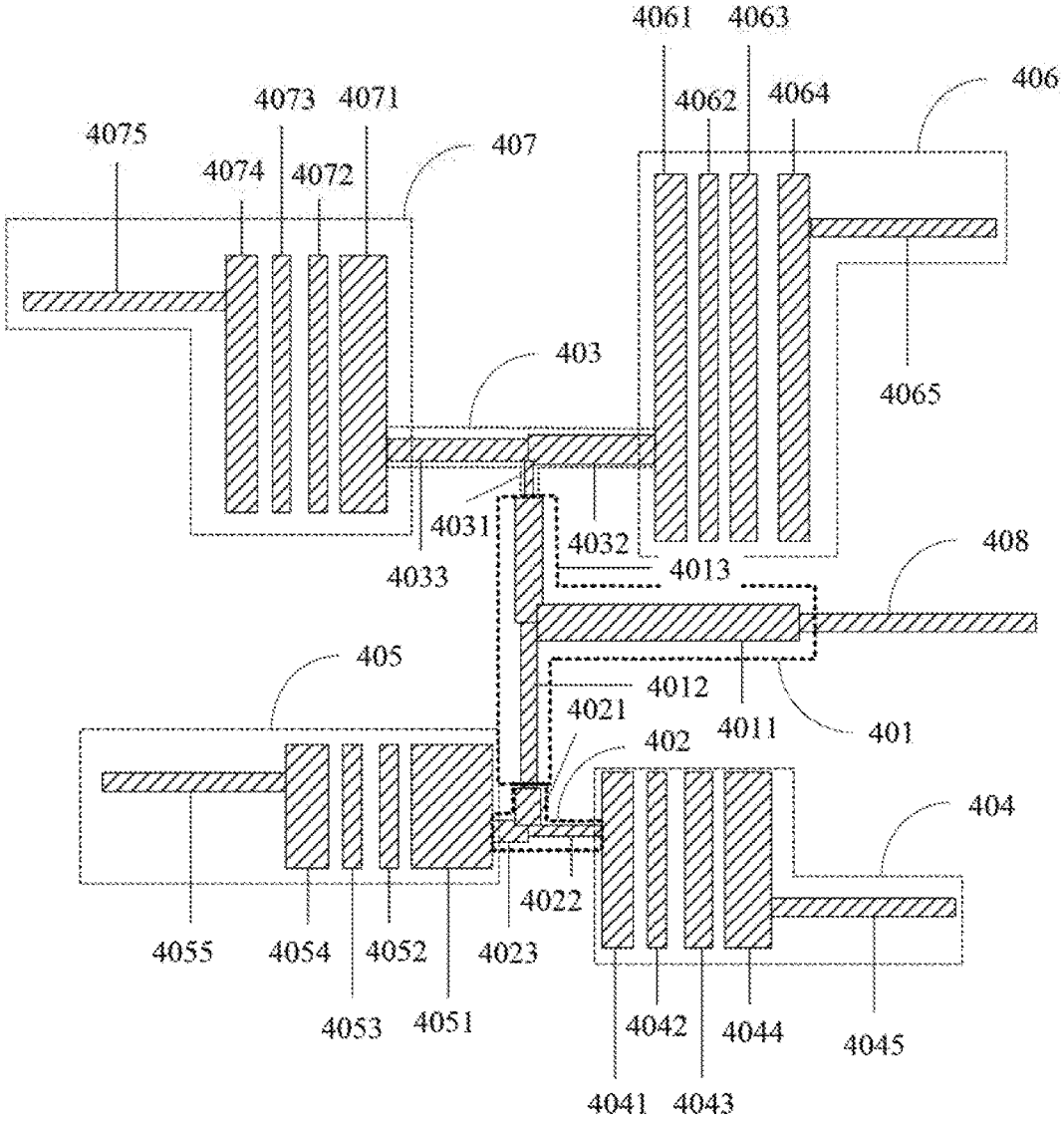
FIG. 5 is yet another schematic structural diagram of a microstrip multiplexer according to an embodiment of the present invention.

Referring to FIG. 5, FIG. 5 is yet another schematic structural diagram of a microstrip multiplexer according to an embodiment of the present invention. In this embodiment of the present invention, the microstrip multiplexer includes a feeder 408, multiple T-shaped heads (401, 402, and 403), and multiple microstrip filters (404, 405, 406, and 407). In this embodiment of the present invention, that a quantity of the microstrip filters is 4 is used as an example for description. A quantity of the T-shaped heads is determined by the quantity of the microstrip filters. Correspondingly, the quantity of the T-shaped heads is 3. It should be noted that, in this embodiment of the present invention, the microstrip multiplexer is not limited to a quadplexer. All multiplexers, of another level, designed based on a microstrip multiplexer structure in this embodiment of the present invention fall within the protection scope of the present invention.

For ease of description, the three T-shaped heads are respectively referred to as a first-stage T-shaped head 401, a second-stage T-shaped head 402, and a third-stage T-shaped head 403. The four microstrip filters are respectively referred to as a first filter 404, a second filter 405, a third filter 406, and a fourth filter 407. In this embodiment of the present invention, for example, the microstrip filters may be interdigital microstrip filters. The interdigital microstrip filters can be designed to be compact in structure and small in size, and have no spurious second harmonic or even-order harmonic, so as to effectively suppress spurious response. Each interdigital microstrip filter includes at least two resonators. A specific order of the resonators may be set and optimized according to a performance parameter of a target microstrip filter that needs, to be designed. One end of each resonator is grounded (not illustrated in the figure), and another end of each resonator is open-circuited. Open-circuited ends of adjacent resonators are in opposite directions. A length of each resonator is approximate to a quarter-wave length corresponding to a center frequency of a filter to which the resonator belongs, and the specific length may be set and optimized according to the performance parameter of the filter. Each resonator may be a round bar or a rectangular bar. In this embodiment of the present invention, as an example, the rectangular bar is used, and the order of resonators is four. Specifically, the microstrip filters may be optimized and designed according to a constraint of a performance parameter such as a passband, a center frequency, an insertion loss, or a return loss of the target microstrip filter that needs to be designed. Details are described in detail in this embodiment of the present invention.

Each T-shaped head includes an impedance transformer and two parallel branch lines. For ease of description, the two parallel branch lines are respectively referred as a first parallel branch line and a second parallel branch line. A microstrip width of each parallel branch line is set according to an impedance matching requirement, and the microstrip widths may be equal or unequal. A characteristic impedance of a microstrip varies according to the width. Before an optimization operation is performed, the microstrip widths of the first parallel branch line and the second parallel branch line are initialized to a width of the feeder. The first parallel branch line and the second parallel branch line are connected to the corresponding impedance transformer in a shape of "T". The impedance transfomer in each T-shaped head is configured to implement impedance matching between tributaries on which the two parallel branch lines are located and a transmission line connected to the impedance transformer. Generally, after optimization, a microstrip width of the first parallel branch line and a microstrip width of the second parallel branch line are unequal. That is, the first parallel branch line and the second parallel branch line are corresponding to microstrips of different characteristic impedances, where the characteristic impedance is not necessarily a characteristic impedance of the feeder. This achieves maximum impedance matching and passband isolation.

In this embodiment of the present invention, the impedance transformer may be preferably a quarter-wave impedance transformer. The quarter-wave impedance transformer may be formed by cascading multiple sections of impedance transformers. In the multi-section stepped impedance transformer, if reflected waves generated by impedance steps cancel each other, a matched frequency band may be expanded. In this way, the multiplexer may be designed as a wideband multiplexer, to implement frequency division multiplexing of multiple wide subband signals.

The first-stage T-shaped head 401 includes an impedance transformer 4011, a first parallel branch line 4012, and a second parallel branch line 4013. The second-stage T-shaped head 402 includes an impedance transformer 4021, a first parallel branch line 4022, and a second parallel branch line 4023. The third-stage T-shaped head 403 includes an impedance transformer 4031, a first parallel branch line 4032, and a second parallel branch line 4033. The first filter 404 includes a first-stage resonator 4041, a second-stage resonator 4042, a third-stage resonator 4043, a fourth-stage resonator 4044, and a pigtail 4045, and the pigtail 4045 of the first filter 404 is perpendicularly connected to the fourth-stage resonator 4044 of the first filter 404. The second filter 405 includes a first-stage resonator 4051, a second-stage resonator 4052, a third-stage resonator 4053, a fourth-stage resonator 4054, and a pigtail 4055, and the pigtail 4055 of the second filter 405 is perpendicularly connected to the fourth-stage resonator 4054 of the second filter 405. The third filter 406 includes a first-stage resonator 4061, a second-stage resonator 4062, a third-stage resonator 4063, a fourth-stage resonator 4064, and a pigtail 4065, and the pigtail 4065 of the third filter 406 is perpendicularly connected to the fourth-stage resonator 4064 of the third filter 406. The fourth filter 407 includes a first-stage resonator 4071, a second-stage resonator 4072, a third-stage resonator 4073, a fourth-stage resonator 4074, and a pigtail 4075, and the pigtail 4075 of the fourth filter 407 is perpendicularly connected to the fourth-stage resonator 4074 of the fourth filter 407. A length of each resonator is approximate to a quarter-wave length corresponding to a center frequency in a passband of a filter. Specifically, the length may be set and optimized according to a performance parameter of a micro trip filter that needs to be designed. Adjacent resonators in the microstrip filters are in a coupling relationship. A feeding manner of the pigtail of each filter includes coupled feeding and tapped feeding. A feeding manner of each pigtail shown in the figure is tapped feeding. A specific tap position may be optimized according to a frequency response characteristic of the filter.

The first-stage resonator 4041 of the first filter 404 is perpendicularly connected to the first parallel branch line 4022 of the second-stage T-shaped head 402. The first-stage resonator 4051 of the second filter 405 is perpendicularly connected to the second parallel branch line 4023 of the second-stage T-shaped head 402. The first parallel branch line 4022 of the second-stage T-shaped head 402 and the second parallel branch line 4023 of the second-stage T-shaped head 402 are connected to the impedance transformer 4021 of the second-stage T-shaped head 402 in a shape of "T". The first-stage resonator 4061 of the third filter 406 is perpendicularly connected to the first parallel branch line 4032 of the third-stage T-shaped head 403. The first-stage resonator 4071 of the fourth filter 407 is connected to the second parallel branch line 4033 of the third-stage T-shaped head 403. The first parallel branch line 4032 of the third-stage T-shaped head 403 and the second parallel branch line 4033 of the third-stage T-shaped head 403 are connected to the impedance transformer 4031 of the third-stage T-shaped head 403 in a shape of "T". The impedance transformer 4021 of the second-stage T-shaped head 402 is connected to the first parallel branch line 4012 of the first-stage T-shaped head 401. The impedance transformer 4031 of the third-stage T-shaped head 403 is connected to the second parallel branch line 4013 of the first-stage T-shaped head 401. The first parallel branch line 4012 of the first-stage T-shaped head 401 and the second parallel branch line 4013 of the first-stage T-shaped head 401 are connected to the impedance transformer 4011 of the first stage T-shaped head 401 in a shape of "T". The impedance transformer 4011 of the first-stage T-shaped head 401 is connected to the feeder 408. Widths of the resonators are not necessarily equal. An open-circuit stub may be introduced to the resonators in each microstrip filter as required, to generate a transmission zero. In this way, an input impedance of the filter is zero at a specific frequency, thereby improving near-end suppression of the microstrip filter.

An impedance transformer in a T-shaped head is configured to implement impedance matching between tributaries on which two parallel branch lines of the T-shaped head are located and an upper-level transmission line (a transmission line connected to the impedance transformer in the T-shaped head. For example, the impedance transformer 4011 of the first-stage T-shaped head 401 matches an impedance of tributaries on which the first parallel branch line 4012 and the second parallel branch line 4013 of the first-stage T-shaped head 401 are located to a characteristic impedance of the feeder 408 (where a transmission line connected to the impedance transformer 4011 of the first-stage T-shaped head 401 is the feeder 408). The impedance transformer 4021 of the second-stage T-shaped head 402 matches an impedance of tributaries on which the first parallel branch line 4022 and the second parallel branch line 4023 of the second-stage T-shaped head 402 are located to a characteristic impedance of the first parallel branch line 4012 of the first-stage T-shaped head 401 (where a transmission line connected to the impedance transformer 4021 of the second-stage T-shaped head 402 is the first parallel branch line 4012 of the first-stage T-shaped head 401). The impedance transformer 4031 of the third-stage T-shaped head 403 matches an impedance of tributaries on which the first parallel branch line 4032 and the second parallel branch line 4033 of the third-stage T-shaped head 403 are located to a characteristic impedance of the second parallel branch line 4013 of the first-stage T-shaped head 401 (where a transmission line connected to the impedance transformer 4031 of the third-stage T-shaped head 403 is the second parallel branch line 4013 of the first-stage T-shaped head 401). In an impedance matching process, microstrip widths of the first parallel branch line and the second parallel branch line in each stage of T-shaped head may be unequal, thereby implementing maximum impedance matching and passband isolation and ensuring a good frequency response.

In an embodiment, microstrip widths of the quarter-wave impedance transformers (4011, 4021, and 4031) may be unequal to a width of the feeder 408, and are specifically set and optimized according to an actual situation. Generally, because frequency responses of the multiple microstrip filters are different, to implement impedance matching, a characteristic impedance of microstrips used by the impedance transformers is different from a characteristic impedance of the feeder 408. Therefore, the microstrip widths of the impedance transformers (4011, 4021, and 4031) are unequal to the width of the feeder 408. In the quadplexer described in FIG. 5, the microstrip widths of the impedance transformers are unequal. It should be noted that, in some specific cases, the microstrip widths of the impedance transformers may be equal to the width of the feeder 408. For example, when the impedance of the tributaries on which the two parallel branch lines of the impedance transformer 4011 is 100 ohms and the characteristic impedance of the feeder is 50 ohms, an impedance obtained after the tributaries, on Which the two parallel branch lines are cascaded is 50 ohms, which is equal to the characteristic impedance of the feeder. Therefore, the microstrip used by the impedance transformer 4011 is a microstrip with a characteristic impedance of 50 ohms. In this way, the microstrip width of the impedance transformer 4011 is equal to the width of the feeder 408. In this embodiment of the present invention, impedance matching and passband isolation between the impedance transformers and the parallel branch lines may be implemented by using transmission lines with different characteristic impedances.

In this embodiment of the present invention, each microstrip filter is connected to a parallel branch line of a T-shaped head. A length of a parallel branch line connected to each microstrip filter may be unequal to a quarter-wave length corresponding to a center frequency of a microstrip filter connected to an adjacent parallel branch line, and may be specifically set according to an actual requirement. For example, referring to FIG. 5, it can be learned that the first filter 404 is connected to the first parallel branch line 4022 of the second-stage T-shaped head 402, a parallel branch line adjacent to the first parallel branch line 4022 of the second-stage T-shaped head 402 is the second parallel branch line 4023 of the second-stage T-shaped head 402, and the second filter 405 is connected to the second parallel branch line 4023 of the second-stage T-shaped head 402. A length of the first parallel branch line 4022 of the second-stage T-shaped head 402 is not necessarily equal to a quarter-wave length corresponding to a center frequency of the second filter 405, and a length of the second parallel branch line 4023 of the second-stage T-shaped head 402 is not necessarily equal to a quarter-wave length corresponding to a center frequency of the first filter 404. Correspondingly, a length of the first parallel branch line 4032 of the third-stage T-shaped head 403 is not necessarily equal to a quarter-wave length corresponding to a center frequency of the fourth filter 407, and a length of the second parallel branch line 4033 of the third-stage T-shaped head 403 is not necessarily equal to a quarter-wave length corresponding to a center frequency of the third filter 406. Specifically, the length of the parallel branch line connected to each microstrip filter may be set and optimized according to a performance parameter such as a frequency response characteristic of each microstrip filter and a characteristic impedance of the feeder. Generally, the length of the parallel branch line connected to each microstrip filter is unequal to the quarter-wave length corresponding to the center frequency of the microstrip filter connected to the adjacent parallel branch line, to better implement impedance matching.

In an embodiment, a microstrip width of the first-stage resonator in each microstrip filter is adjustable. The first-stage resonator is a resonator connected to a parallel branch line of a T-shaped head. For example, referring to FIG. 5, the microstrip widths of the first-stage resonator 4041 of the first filter 404, the first-stage resonator 4051 of the second filter 405, the first-stage resonator 4061 of the third filer 406, and the first-stage resonator 4071 of the fourth filter 407 are adjustable. In an impedance matching optimization process, a width of a gap between resonators may also be optimized, thereby ensuring that the first-stage resonators match the connected parallel branch lines.

In another embodiment, the designed microstrip multiplexer may further include at least one open-circuit stub. One end of the open-circuit stub is connected to a T-shaped head, and another end of the open-circuit stub is open-circuited. (This is not shown in the figure). The open-circuit stub may be a sector-type capacitor. Impedance matching of different levels of impedance is better implemented by changing a length of the open-circuit stub or by using sector-type capacitors of different impedances to introduce different inductive reactance or capacitive reactance, thereby improving a frequency band response of each microstrip filter.

It should be noted that, when the microstrip multiplexer in this embodiment of the present invention is designed, to avoid a case in which a frequency band response of a subband is unsatisfactory, a redundancy design method may be used for designing. For example, a redundant microstrip filter is used as a stub load, to replace a conventional method in which a simple short circuit wire or an open circuit wire is used as a load, thereby implementing better impedance matching between another microstrip filter and a T-shaped head. Optionally, the multiple microstrip filters in the microstrip multiplexer may include a redundant microstrip filter. The redundant microstrip filter is used as a matched load with a band-pass characteristic, and is configured to improve a matching effect of the T-shaped head, thereby improving a frequency band response of the another microstrip filter. For example, when a triplexer is designed, four microstrip filters are used. The triplexer is designed according to a requirement on a quadplexer, and the redundant microstrip filter is used as a load, where the load has a band-pass characteristic. For another example, if a quintuplexer is designed, six microstrip filters are used. The redundant microstrip filter is used as a matched load with a band-pass characteristic. In this way, a matching effect that cannot be achieved by using a complex T-shaped head is implemented, thereby improving a frequency band response of each microstrip filter.

Figure 6:
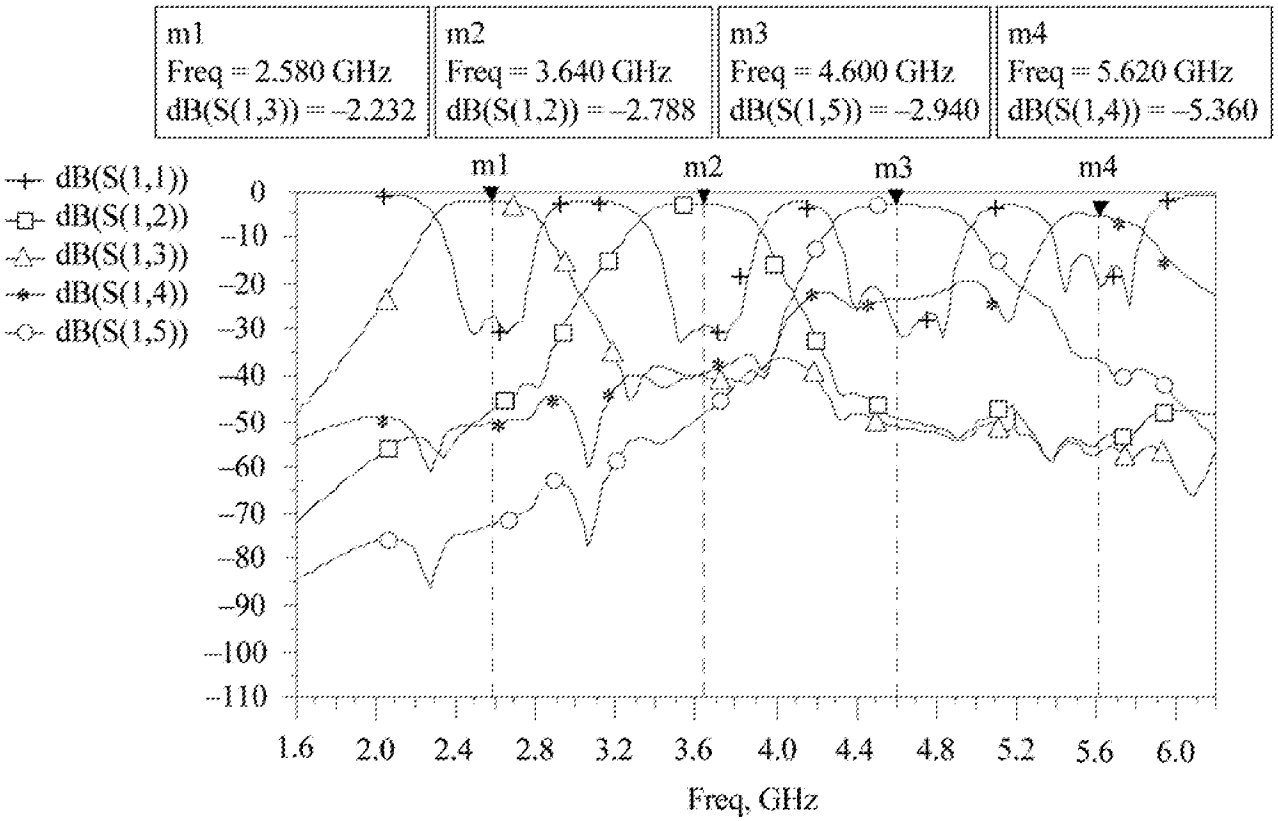
FIG. 6 is a schematic diagram of a frequency response of the microstrip multiplexer provided in FIG. 5.

Referring to FIG. 6, FIG. 6 is a schematic diagram of a frequency response of the microstrip multiplexer provided in FIG. 5. The frequency response includes an insertion loss frequency response {dB(1,2) dB(1,3), dB(1,4), dB(1,5)} and a return loss frequency response dB(1,1). It can be seen from the figure that the designed quadplexer is a wideband multiplexer. A passband bandwidth of each filter is approximately 300 MHz, and the microstrip filters have good frequency band response.

In the microstrip multiplexer described in this embodiment of the present invention, multiple microstrip filters are connected to at least one T-shaped head. The T-shaped head includes an impedance transformer, a first parallel branch line, and a second parallel branch line. The first parallel branch line and the second parallel branch line are connected to the impedance transformer in a shape of "T". Each of the multiple microstrip filters is connected to a parallel branch line of the T-shaped head, and an impedance transformer of a T-shaped head is connected to a feeder. In this embodiment of the present invention, a wideband multiplexer that combines multiple wide subband signals for using can be implemented, and each subband has good frequency band response.

It should be noted that the terms "first" and "second" are merely intended for a purpose of description, and shall not be understood as an indication or implication of relative importance or implicit indication of the number of indicated technical features. Therefore, a feature limited by "first" or "second" may explicitly or implicitly include at least one of the feature.

The foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof. The modifications or replacements made shall fall within the scope of the present invention without departing from the principle of the present invention.

What is claimed is:

1. A microstrip multiplexer, comprising:

a feeder;

multiple microstrip filters; and a signal processing network, wherein the multiple microstrip filters are separately connected to the signal processing network, and the signal processing network is connected to the feeder; and output signals of the multiple microstrip filters are combined by using the signal processing network and then output by using the feeder, and/or a signal input from the feeder is split by using the signal processing network and then output to the microstrip filters, wherein a Wilkinson power divider is disposed in the signal processing network, and each microstrip filter of the multiple microstrip filters is an interdigital microstrip filter.

2. The microstrip multiplexer according to claim 1, wherein a feeding manner of a pigtail of each of the microstrip filters comprises coupled feeding and tapped feeding.

3. A microstrip multiplexer, comprising:

a feeder;

multiple microstrip filters; and a signal processing network, wherein the multiple microstrip filters are separately connected to the signal processing network, and the signal processing network is connected to the feeder; and output signals of the multiple microstrip filters are combined by using the signal processing network and then output by using the feeder, and/or a signal input from the feeder is split by using the signal processing network and then output to the microstrip filters, wherein at least one T-shaped head is disposed in the signal processing network;

the T-shaped head comprises an impedance transformer, a first parallel branch line, and a second parallel branch line, wherein the first parallel branch line and the second parallel branch line are connected to the impedance transformer in a shape of "T", the multiple microstrip filters comprise two microstrip filters that are respectively connected to the first parallel branch line and the second parallel branch line, and the impedance transformer in the at least one T-shaped head is connected to the feeder; and the T-shaped head is configured to implement impedance matching between the multiple microstrip filters and the feeder.

4. The microstrip multiplexer according to claim 3, wherein the impedance transformer is a quarter-wave impedance transformer.

5. The microstrip multiplexer according to claim 4, wherein a microstrip width of the first parallel branch line and a microstrip width of the second parallel branch line are unequal.

6. The microstrip multiplexer according to claim 4, further comprising at least one open-circuit stub, wherein one end of the open-circuit stub is connected to the T-shaped head, and another end of the open-circuit stub is open-circuited.

7. The microstrip multiplexer according to claim 4, wherein a microstrip width of the quarter-wave impedance transformer and a width of the feeder are unequal.

8. The microstrip multiplexer according to claim 3, wherein a length of the parallel branch line connected to each microstrip filter is unequal to a quarter-wave length corresponding to a center frequency of a microstrip filter connected to an adjacent parallel branch line.

9. The microstrip multiplexer according to claim 3, wherein the multiple microstrip filters comprise a redundant microstrip filter, and the redundant microstrip filter is a matched load with a band-pass feature.

10. The microstrip multiplexer according to claim 3, wherein the microstrip filters are interdigital microstrip filters.

11. The microstrip multiplexer according to claim 10, wherein each of the interdigital microstrip filters comprises at least two resonators, wherein one end of each resonator of the at least two resonators is open-circuited, another end of each resonator of the at least two resonators is grounded, and a microstrip width of a resonator connected to the parallel branch line is adjustable.

12. A microstrip multiplexer, comprising:

a feeder;

multiple microstrip filters; and a signal processing network, wherein the multiple microstrip filters are separately connected to the signal processing network, and the signal processing network is connected to the feeder; and output signals of the multiple microstrip filters are combined by using the signal processing network and then output by using the feeder, and/or a signal input from the feeder is split by using the signal processing network and then output to the microstrip filters, wherein the signal processing network comprises a first-stage T-shaped head, a second-stage T-shaped head, and a third-stage T-shaped head, wherein the first-stage T-shaped head comprises an impedance transformer, a first parallel branch line, and a second parallel branch line, the second-stage T-shaped head and the third-stage T-shaped head are respectively connected to the first parallel branch line and the second parallel branch line, and the multiple microstrip filters are respectively connected to the second-stage T-shaped head and the third-stage T-shaped head.

* * * * *